United States Patent [19]

Pantalone

[11] Patent Number: 4,524,555

[45] Date of Patent: Jun. 25, 1985

[54] SECTION-IRON FOR BRACES OR UPRIGHTS FOR LATTICE GIRDERS AND LIKE STRUCTURES

[76] Inventor: Antonio Pantalone, Via Carpaccio 4, Milan, Italy, 20133

[21] Appl. No.: 171,351

[22] Filed: Jul. 23, 1980

[30] Foreign Application Priority Data

Jul. 26, 1979 [IT] Italy ..... 24717 A/79

[51] Int. Cl.[3] ..... E04C 3/06; E04C 3/32; E04H 12/10

[52] U.S. Cl. ..... 52/738; 52/648; 52/655

[58] Field of Search ..... 52/655, 654, 648, 738, 52/282, 40

[56] References Cited

U.S. PATENT DOCUMENTS 2,731,116 1/1956 Allison ..... 52/731
2,975,227 3/1961 Wiater et al. ..... 52/282 X

FOREIGN PATENT DOCUMENTS 930997 7/1963 United Kingdom ..... 52/654

*Primary Examiner*—Alfred C. Perham
*Attorney, Agent, or Firm*—Shlesinger, Fitzsimmons & Shlesinger

[57] ABSTRACT

A novel outline for section irons to be used in truss girders and like constructions is disclosed, which essentially consists of a box-like open structure composed by a longer angle iron (11, 11*a*) from the free end of which there are extended, at right angles outwards, L-shaped extensions (12, 13, 12*a*, 13*a*) having sides equal to one half of those of the angle iron. Bending stresses can be minimized and the entire structure is more conveniently assembled and has a reduced weight.

2 Claims, 1 Drawing Figure

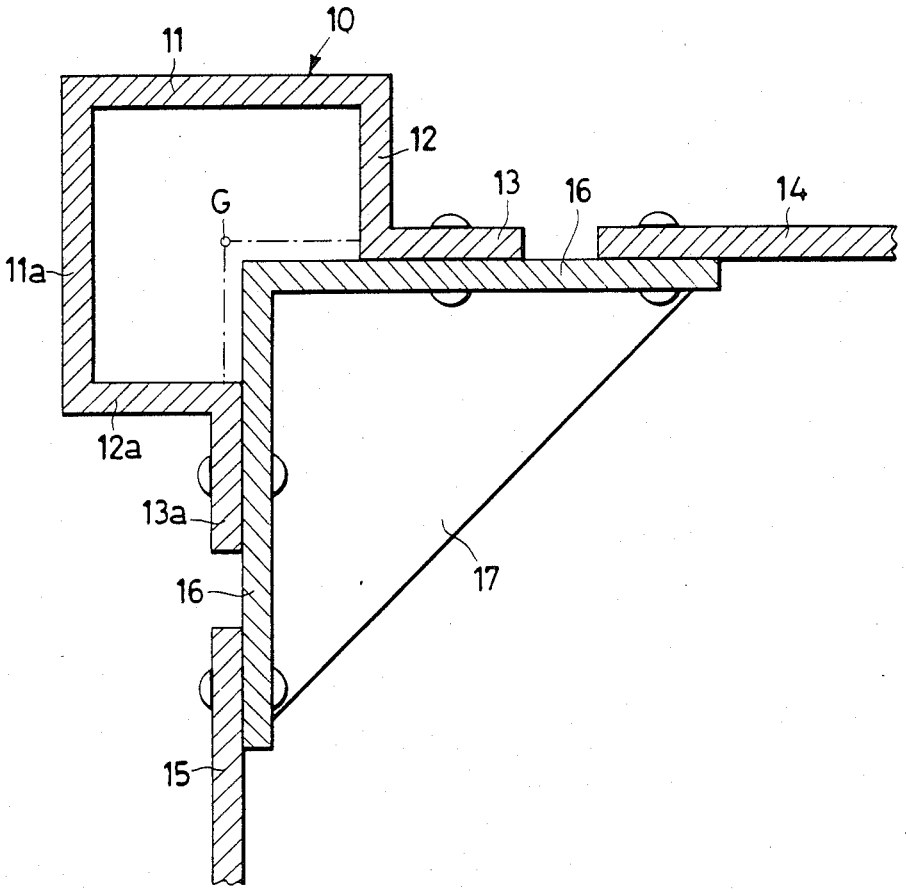
10
11
12
13
16
14
G
11a
12a
13a
16
17
15

SECTION-IRON FOR BRACES OR UPRIGHTS FOR LATTICE GIRDERS AND LIKE STRUCTURES

This invention relates to a section-iron for braces or uprights of lattice girders and like structures.

Heretofore the structures, for example of the lattice girder type, were constructed by using four braces or uprights consisting of hot-rolled or cold-rolled sections connected to each other by means of side struts.

More particularly, there were used hot-rolled sections of the H-beam type, having long, normal or short flanges.

The long-flanged H-beam sections have the defect that they are exceedingly heavy so that they do not lend themselves to an economically acceptable use in lightweight structures. In addition, since such sections have two different center lines, there are differences in the connections of the side struts to the two main sides of the lattice structure.

The H-beams having normally long or short flanges, although they are more lightweight than the long-flanged ones, have considerably different radiii of inertia, and this involves a heavy oversizing on the side having the least inertia and the differences in the connections to the two sides are still more pronounced.

Also for the U-shaped sections, the same considerations apply as for the H-beams having normal or short flanges.

The angle irons having equal sides are an advantage due to the convenience of assembly of the connections to the side struts because the two sides are arranged along the edge, but they have nonetheless a minimum inertia radius which is very reduced: this fact involves considerable shortcomings.

Moreover, since the centre of gravity of such angle irons falls outside the planes of the two sides, there are always secondary influences (bending moments) with considerable shortcomings and thus the own weights become considerable.

Also tubular irons are used, which have circular or square cross-sections: especially these latter facilitate the design and installation somewhat inasmuch as they have equal centre lines on two sides which are shifted 90° apart from one another. They have long radii of inertia an thus they are less loaded and are comparatively lightweight, but the construction costs are exceedingly high on account of the requirement of welding the structural members in a sealtight manner consistently with the official specifications for the protection against corrosion. It becomes thus necessary to shape the cutting for the round tubular sections and to move the piece being welded for the welding on the surface of the square and round tubes.

An object of the present invention is to provide a section-iron for braces or uprights of structures in general, and, more particularly, of truss girders, said section-iron offsetting the drawbacks of the rolled sections used heretofore while permitting an easy connection of the side struts without having the latter causing bending stresses.

In order that these objects may be achieved, it has been envisaged to provide a special rolled section which has been so shaped and sized as to have the stresses acting through the connections for the side struts to pass through the centre of gravity of the section.

The problem has been solved by an angle iron having equal sides, characterized in that each side of the angle iron is extended at its free end by a first extension having a length equal to one half the length of the side and shifted angularly 90° apart with respect to the relative side in the same direction as the other side of the angle iron, and with a second extension which has also a length equal to one half of the side length and is angularly shifted 90° apart with respect to the first extension in the direction away of the other side of the angle iron.

With a section having these features, the result is achieved of having the lines of action of the forces acting through the connections of the side struts to the brace or upright mutually intersecting on the axis passing through the centre of gravity of the section. Thus the secondary effects due to the bending stresses are virtually neutralized. In addition, inasmuch as the section has rectilinear end extensions arranged at 90° the one with respect to the other, the fastening of the connections for the side struts is facilitated and a fully satisfactory symmetry on both sides can thus be obtained.

The section according to the invention, moreover, possesses a long radius of inertia so as to prevent exceedingly intensive stresses, the result being a reduced own weight: thus longer spans can be bridged with reduced sags, when all the other conditions are the same.

Another advantage afforded by the section according to the invention is that reduced times are required for preparing the drawings of the lattice girders: it is enough, in fact, to establish the positions of the connections for the side struts: these connections have the form of plates, angle irons and the like and can be fastened by bolting, welding or otherwise. There is thus an extreme simplicity of construction struction and installation by using standard structural members which are cheaply available.

The section-iron for braces or uprights according to this invention is shown in cross-sectional view in the accompanying drawing.

As can be seen, the section generally indicated at 10, comprises an angle iron having two equal sides 11, 11*a*: from the free ends of the latter, there extend bent extensions 12, 13, and 12*a*, 13*a*, respectively. More particularly, there is a first extension 12, or 12*a* respectively, the length of which is one half the length of a side 11 (or 11*a* as the case may be) of the angle iron and which is shifted through 90° relative to its appertaining side 11 or 11*a* in the same direction as the other side of the angle iron.

In addition, there is a second extension 13 and 13*a* respectively, the length of which is, also, one half of the length of a side 11, or 11*a* of the angle iron and is angularly shifted 90° apart relative to the first extension 12, or 12*a* and is extended in the direction away of the other side 11*a* or 11 of the angle iron.

It can easily be appreciated that the section iron in question is a perfectly symmetrical section, the gravity axis of which, shown at G, is the line of intersection of the planes passed through the midway axes of the extensions 13 and 13*a*.

If there are fastened to such extensions 13, 13*a* of the section 10, for example by bolting as depicted in the drawing, or also by welding, connection pieces in the form of plates, angle plates and like members, to which, in turn, the side struts of the lattice girder will be fastened, it can be seen not only that these connection members are identical for the two sides of the brace or the upright, but also that the lines of action of the forces which act through the connection members upon the section intersect just on the centre of gravity of the section, so that no bending stresses are experienced, which would be susceptible of originating detrimental side effects.

In the example shown, the connections for the side struts 14, 15, consist of an angular tab 16 stiffened by a rib 17, the tab 16 being fastened, in correspondence with its two sides, to the extensions 13, 13*a* of the section 10. By so doing, any possibility of bending of the sides 12, 12*a* relative to the attendant sides 11, 11*a* of the section is effectively prevented.

It can likewise be seen that the section according to the invention possesses a long radius of inertia so that the section can be made with a reduced own weight and can be used for lightweight structures capable of bridging wide spans with little sags.

The shaped section according to the invention can be obtained by cold bending, but there is nothing, of course, against producing it also by hot rolling, if preferred.

I claim:

1. A section-iron for braces or uprights of lattice girders, comprising an equal-sided angle iron, characterized in that each side of the angle iron is equal in length and is extended at its free end by a first extension having a length equal to one half the length of a side and extending angularly at 90° with respect to the associated side, and in the same direction as the other side of the angle iron, and by a second extension which has also a length equal to one half of the side length of the angle iron and which extends angularly at 90° with respect to the first extension, and in the direction away of said other side of the angle iron.

2. A section-iron for braces as defined in claim 1, wherein said angle iron is right angular in cross sectional configuration, and said second extensions lie in planes which intersect along the gravity axis of said angle iron.

* * * * *